United States Patent [19]

Judge

[11] Patent Number: 4,592,502

[45] Date of Patent: Jun. 3, 1986

[54] OFFSET ELECTRIC STAPLER

[75] Inventor: Alfred H. Judge, Raleigh, N.C.

[73] Assignee: Black & Decker Inc., Newark, Del.

[21] Appl. No.: 667,976

[22] Filed: Nov. 5, 1984

[51] Int. Cl.[4] ..... B25C 5/15

[52] U.S. Cl. ..... 227/131

[58] Field of Search ..... 227/120, 131, 156

[56] References Cited

U.S. PATENT DOCUMENTS

| | | | |
|---|---|---|---|
| 3,347,438 | 10/1967 | Doherty | 227/131 |
| 3,786,978 | 1/1974 | Manganaro | 227/131 X |
| 4,005,812 | 2/1977 | Doyle et al. | 227/131 |
| 4,491,262 | 1/1985 | Ewig | 227/131 |

FOREIGN PATENT DOCUMENTS

| | | | |
|---|---|---|---|
| 1290830 | 3/1962 | France | 227/131 |

*Primary Examiner*—Paul A. Bell

*Attorney, Agent, or Firm*—Finnegan, Henderson, Farabow, Garrett & Dunner

[57] ABSTRACT

An offset electric stapler having an armature that is axially restrained primarily by its interaction with the interior surface of the driving coil. By supporting the armature with the coil and minimizing the offset between the armature and the staple driving blade, an improved stapler is obtained.

8 Claims, 7 Drawing Figures

OFFSET ELECTRIC STAPLER

BACKGROUND OF THE INVENTION

I. Field of the Invention

The present invention relates to an electric offset staple driving device.

II. Background of the Invention

The use of an electric tool to drive staples or the like is normally accomplished with a device such as depicted in U.S. Pat. No. 4,005,812 to Doyle et al. In such a device, a vertically disposed coil is activated to drive a centrally located armature down through the coil toward the staple to be driven. In the above-noted patent, the blade engaging the staple is located centrally in the armature and, therefore, the distance between the edge of the stapler and the location where the staple is driven is greater than half the thickness of the coil. In applications where it is desired to place the staple up against a vertical surface, the location of the blade within the center of the coil is at a significant disadvantage. Therefore, staplers have been constructed having the driving blade offset from the center of the coil, such that the driving blade is more closely associated with the front edge of the stapler. Such a device is depicted in U.S. Pat. No. 3,786,978 to Manganaro.

In such a device, the driving blade is linked to the armature by means of a rigid member that propels the driving blade downward with the downward movement of the armature. Because the driving blade is offset from the vertical axis of the coil, a torque is created when the driving blade strikes the staple. Since this torque can cause the armature to bind or jam within the coil, means are provided for restraining the movement of the armature in a radial direction from the central axis of the coil. In the above-noted Manganaro patent, the device includes an upper support that surrounds a vertical extension of the armature to provide radial support for the armature. The existence of this radial support and the elements necessary to confine the armature in a radial direction complicate the structure and increase the cost of production of such a device. As is apparent from the Manganaro patent, this also increases the height of the device which in certain applications can be detrimental.

Therefore, it is the primary object of the present invention to provide an offset stapler that effectively operates without the above-noted shortcomings of the prior art. Specifically, one of the objects of the present invention is to provide an offset electric stapler that is inexpensive to manufacture, has a minimum of moving parts and operates effectively without the shortcomings of offset electric staplers that require radial support mechanisms for the armature.

Other objects and advantages of the invention will be apparent from the description of the preferred embodiments or may be learned by practice of the invention.

SUMMARY OF THE INVENTION

In order to accomplish the above-noted objects of the invention, there is provided an electric stapler having a housing containing a staple driving mechanism, a switch means and a staple magazine. The staple driving mechanism comprises a cylindrical coil electrically connected to the switch means. The coil is disposed around a smooth axial bore. An armature is disposed to move co-axially within the bore when the coil is activated. Spring means bias the armature axially away from the coil and an offset link affixes the upper end of the armature to an elongated staple driving member. The staple driving member has a staple engaging end and a driven end and is generally parallel to the axis of the coil. The driven end of the staple engaging member is affixed to the offset link and the mechanism is characterized by the movement of the armature being guided primarily by the interior surface of the bore.

Preferably, the distance between the fastener engaging member and the central axis of the bore is reduced to a minimum. In addition, it is preferred that the radial clearance between the armature within the bore of the coil be reduced to a minimum.

DESCRIPTION OF THE PREFERRED EMBODIMENT

The present invention will now be disclosed in terms of the embodiment depicted in the accompanying figures, which constitute an intregal part of this specification.

Figure 1:
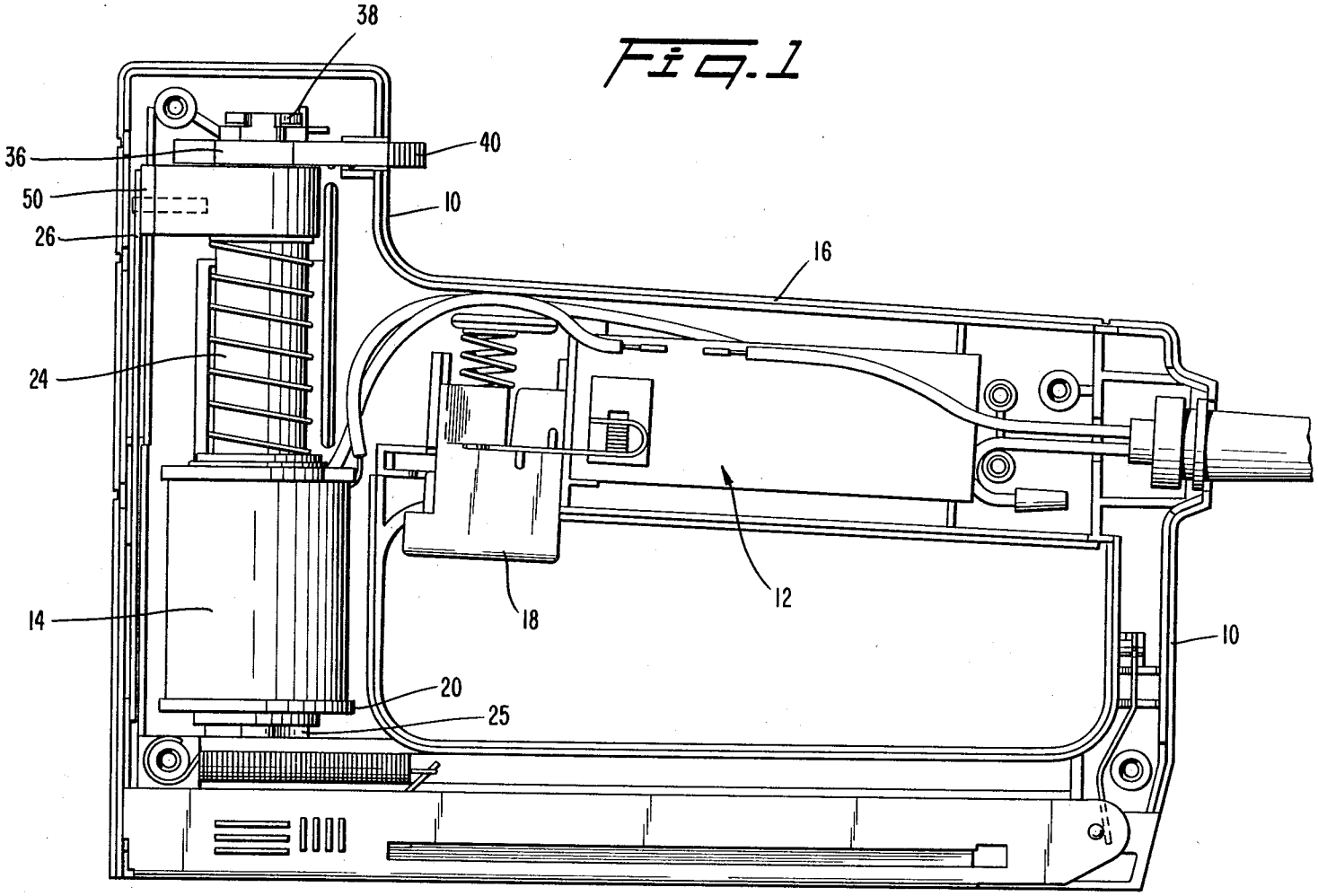
FIG. 1 is a cross-sectional side view of one embodiment of the invention depicting the relationship of the basic components.

In accordance with the invention, the electric stapler includes a staple driving mechanism, switch means and a staple magazine. As embodied in FIG. 1, the device is an offset electric stapler having a housing 10 containing switch means 12 disposed to connect a cylindrical coil 14 with a source of electricity. The housing 10 has a generally horizontally disposed handle portion 16 which encloses the switch means 12 and a trigger 18.

Figure 2:
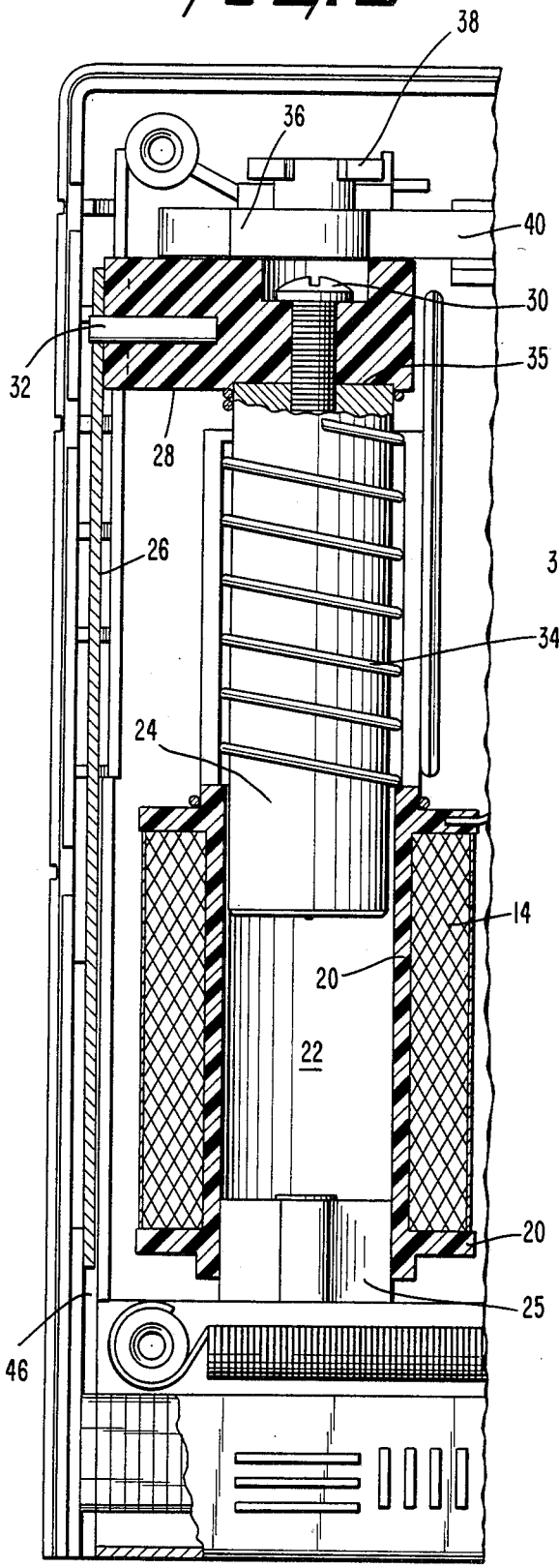
FIG. 2 is an enlarged partial cross section of the embodiment of FIG. 1 depicting the device when the coil is not activated.

In accordance with the invention, the coil includes a smooth axial bore. As here embodied, and most clearly depicted in FIGS. 2 and 3, the coil 14 is wound around a cylindrical bobbin 20 that provides a smooth cylindrical interior surface 22. In this embodiment, the bobbin 20 is constructed out of glass reinforced nylon. In the present embodiment, this internal bore interacts with the armature 24 and, as will be disclosed hereinafter, the relationship of the sizes between these two components is significant with respect to operation of the device.

In accordance with the invention, an armature is disposed to move co-axially within the bore when the coil is activated. As here embodied, and most clearly depicted in FIGS. 1 through 3, the armature 24 is a cylindrical ferromagnetic material disposed to fit within the cylindrical bore 22 of the coil 14.

When the coil is actuated, the center of mass of the armature will be forced to the geometric center of the coil. As long as the center of mass of the armature is above the center of the coil, a downward force will be exerted on the armature. A counterforce will be generated if the center of mass of the armature passes the center of the coil. Some staplers use this counterforce to decelerate the armature; however, in the present embodiment, the armature 24 hits the stroke limiting member 25 before the center of the armature reaches the center of the coil 14. In this manner, there is always a downward force on the armature when the coil is actuated. The coil is activated by ½ cycle of the a-c input and reaches a velocity of about 30 ft/sec just prior to impact of the staple and has a total travel of about 1.2 inches.

The initial position of the armature relative to the coil winding determines the initial downward thrust exerted on the armature assembly. The more the armature projects into the coil, the less initial thrust on the armature; however, if the armature is sufficiently remote from the coil, the initial downward thrust is reduced. In the present embodiment, it was determined that maximum impact energy was generated with the armature 24 initially projecting about 0.5 inch into the coil 14.

As previously disclosed, optimum performance for the disclosed embodiment is achieved with an armature velocity at initial staple impact of approximately 30 ft/sec. For this embodiment, approximately ½ inch of pre-travel is needed to reach such a velocity. The mass of the armature assembly, its geometric configuration, and the characteristics of the coil all determine this parameter of operation.

The characteristics of the coil are determined by conflicting criteria. In the present invention, where the coil diameter affects the amount of offset, a minimum diameter is needed yet this diameter of the coil cannot be reduced to a point where the armature is so thin that it is oversaturated by the flux and overheats as a result. In addition, the wire size determines the number of turns that are placed in the coil which, in turn, controls the field strength and the amount of coil heating. The strength of the coil is also affected by its length but that is limited by the length of travel of the armature.

The present embodiment uses an armature having a diameter of about 17 mm, a coil having an inside diameter of about 20 mm and an outside diameter of 35 mm. The coil is approximately 40 mm long and is wound with #21 gauge wire. These dimensions of the coil refer to the windings themselves and are not the dimensions of the associated bobbin 20.

The staple driving mechanism, which includes the staple engaging blade 26, is affixed to the armature 24 by means of an offset link 28. As here embodied, the offset link 28 is a polymeric material affixed to the upper end of the armature 24 by means of a fastener 30. The offset link includes a metal blade engaging member 32 that transmits the force applied through the offset link to the staple engaging member 26. As here embodied, the blade engaging member 32 is a flat pin pressed into the offset link 28. The opening 33 in the blade 32 is elongated to engage the flat pin 32. Preferably, the offset link 28 is constructed out of an electrically non-conductive polymer material, thereby providing double insulation to the device. In the present embodiment, Ryanite 555, a product of E. J. duPont, has been used with success. As shown in the embodiment depicted in FIGS. 2 and 3, the armature 24 engages the offset link 28 within an indentation 35 on the bottom surface of the offset link, thereby accurately locating the offset link with respect to the center line of the armature 24.

In accordance with the invention, the device includes spring means for biasing the armature axially away from the coil. As here embodied and depicted in FIGS. 1 through 3, the helical spring 34 is positioned between the lower surface of the offset link 28 and the upper surface of the coil 14. The spring biases the armature axially upward to a point where the upper surface is engaged by another portion of the device which will be disclosed below. Because the spring opposes the driving force of the coil, it should only be strong enough to return the armature to its original position, with the lowest possible spring rate. However, the solid height of the compressed spring, the wire size, and number of turns limit the reduction of the spring rate.

Figure 3:
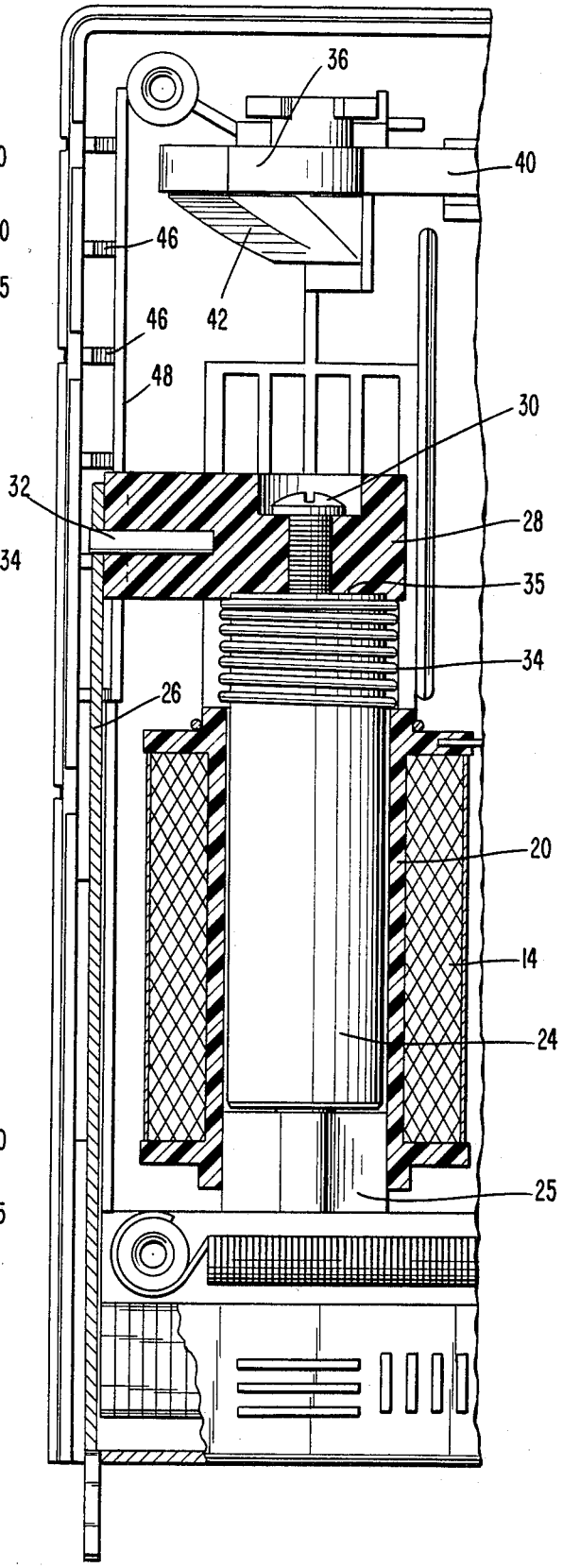
FIG. 3 is a view of the device identical to FIG. 2, except the coil has been activated to engage and drive a staple.
Figure 4:
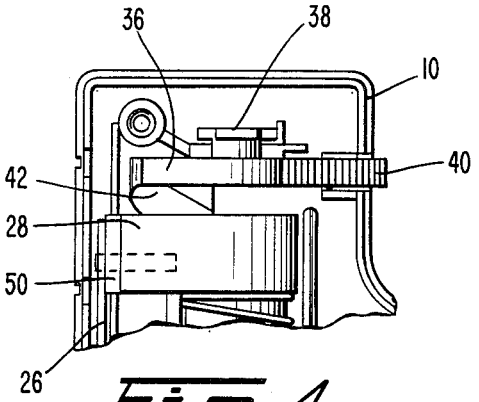
FIG. 4 is a partial cross-sectional view of the upper portion of the device depicting the means for adjusting the power applied to the staple.

Upon activation of the coil by the switch 12, the armature is drawn downward to the position depicted in FIG. 3. In doing so, the offset link that is engaged with the staple driving blade is also forced downwardly. The axial movement of the armature is guided primarily by the interior surface of the bore of the coil. This is accomplished in the present embodiment by minimizing the distance between the center line of the coil and the staple engaging blade 26. As here embodied, the device has an offset of the staple engaging blade 26 and the centerline of the armature 14 of about 19 mm.

Additionally, the operation of the present invention is facilitated by minimizing the clearance between the armature 24 and the interior bore 22 of the coil 14. By controlling the diametrical radial clearance between the outside surface of the cylindrical armature and the cylindrical interior surface of the bore for the coil and minimizing the distance between the center line of the armature and the staple engaging blade, it is possible to provide an offset stapler that will function correctly without the necessity for means associated with the upper extremity of the armature to maintain its axial alignment within the coil. This diametrical clearance should be minimized for both magnetic performance and mechanical guidance but should not be so small as to induce frictional drag. For the disclosed embodiment, a diametrical clearance in the range of from 0.35 to 0.85 mm is preferred.

A number of related parameters of the design affect the ability of the present invention to function without auxiliary axial guidance of the armature, including the length of the coil, the radial clearance between the coil and the armature, the amount of the offset, and the longitudinal position of the resistance encountered by the fastener driving portion of the device.

Figure 6:
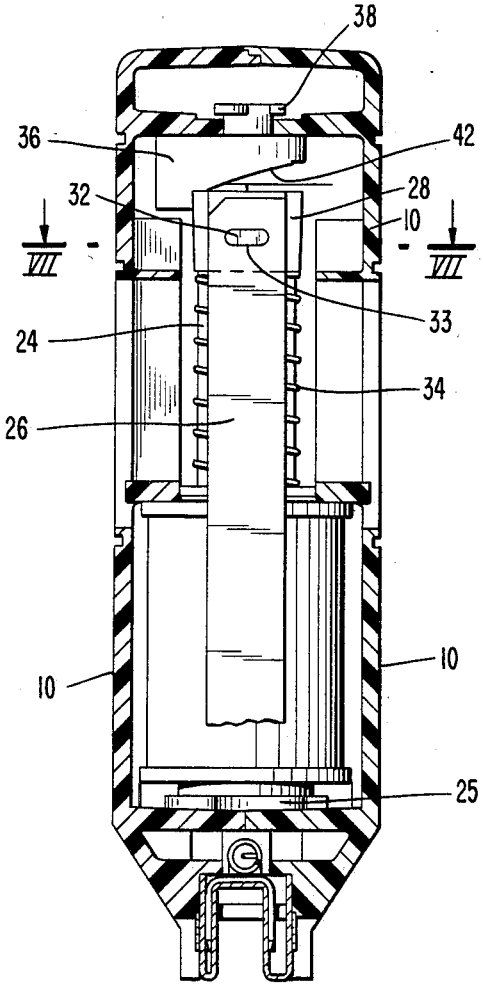
FIG. 6 is an end cross-sectional view of the embodiment of FIGS. 1 through 5 showing the relationship of the components.
Figure 5:
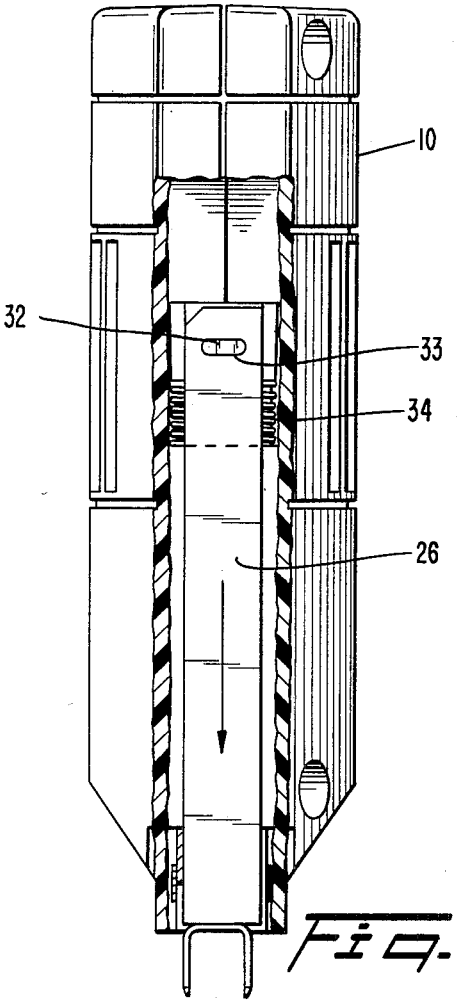
FIG. 5 is a cutaway cross-sectional view depicting the staple engaging member.

Preferably, the device includes means for adjusting the power applied to the staple. As here embodied and most clearly depicted in FIGS. 1, 3 and 6, the present embodiment includes a cam member 36, which is disposed to rotate co-axially with the coil and armature within a boss 38 in the housing 10. Upon rotation of the cam member 36 by means of the lever 40, the cam surface 42 engages the upper surface of the offset link 28 such that the armature and staple engaging member are displaced axially downward prior to activation of the coil. In such a manner, the energy imparted to the staple engaging member is somewhat lessened and staples can be driven into softer materials without the application of excessive force which may push the staple completely through the material being fastened.

The present embodiment also includes means for limiting the downward axial movement of the armature. As most clearly depicted in FIGS. 2 and 3, there is included a rubber energy absorbing member 25 disposed within the bore of the coil 14. The bottom surface of the energy absorbing member 25 rests on a portion of the housing and the upper surface is struck by the bottom surface of the armature 24, as is most clearly depicted in FIG. 3. The location, thickness and elastomeric properties of the energy absorbing member 25 are designed to limit downward axial travel of the armature 24 to the appropriate distance. Thus, the fastener engaging member 26 picks up a staple from the staple magazine and forces it into the appropriate surface until the armature 14 engages the member 25.

The staple engaging blade 26 is located within a groove 46 within the housing 10. The groove locates the blade to keep it in a correct relationship with the staples to be driven and allows it to reciprocate vertically. The drive blade is, in this embodiment, slightly narrower than the groove 46 in the housing, and the opening in the blade is larger than the pin providing limited relative motion between the blade and the pin. This allows the blade to move laterally within the groove.

Because the location of the staple magazine is determined by the housing and the housing also guides the staple engaging blade, the relationship between the staples and the blade is determined by the housing. As a result, the relationship between the staples and the blade is not subject to misalignment that could be the result of locating the staples in a magazine located by means other than the housing, such as another subassembly affixed to the housing.

Figure 7:
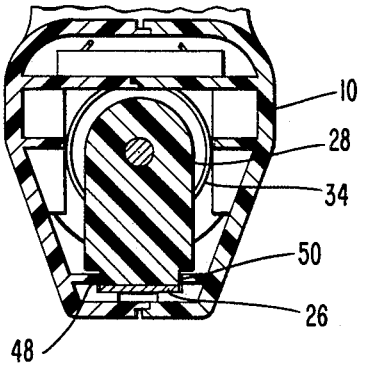
FIG. 7 is a cross-sectional view of the embodiment of FIG. 6 taken along line VII—VII.

In response to movement from the blade driving member 32, the housing further includes guide means for preventing rotational movement of the offset link about the central axis of the coil. As here embodied, and most clearly depicted in FIG. 7, the housing includes shoulders 48 that engage both sides of the offset link 28 in complementary grooves 50 on the offset link.

The present invention has been disclosed in terms of a preferred embodiment and the present invention is not limited thereto. Modifications of this embodiment shall be considered within the scope of the present invention as defined by the following claims and their equivalents.

What is claimed is:

1. An electric stapler having a housing containing a staple driving mechanism, a switch means and a staple magazine, said staple driving mechanism comprising: a cylindrical coil electrically connected to said switch means, said coil being disposed around a smooth axial bore; an armature disposed to move co-axially within said bore when said coil is activated; spring means biasing said armature axially away from said coil; an offset link affixed to the upper end of said armature; an elongated staple-engaging member having a staple-engaging end and a driven end, said member being generally parallel to the axis of said coil, said driven end being affixed to said offset link by means of a pin projecting from said offset link engaging a hole in the driven end of said staple engaging member, said hole in said staple engaging member being larger than said pin thereby allowing said staple engaging member to move somewhat with respect to said pin and said offset link; wherein axial movement of said armature is guided by the interior surface of said bore.

2. An electric stapler having a housing containing a staple driving mechanism comprised of a coil, an armature within said coil, and a staple driving member on said armature, said stapler further comprising a switch means and a staple magazine wherein said housing maintains said coil vertically within one end of said housing, said housing having a generally horizontal handle portion containing said switch means and a staple magazine generally parallel to said handle portion on the lower portion of said housing; said staple driving mechanism comprising a coil having a smooth axial bore; an armature disposed to move co-axially within said bore when said coil is activated; means for biasing said armature axially away from said coil; an offset link affixed to the upper end of said armature; an elongated staple engaging member having a staple engaging end and a driven end; said member being generally parallel to the axis of said coil and disposed between said coil and one edge of said housing within guide means in said housing; said driven end being affixed to said offset link by means of a pin projecting from said offset link engaging a hole in the driven end of said staple engaging member, said hole in said staple engaging member being larger than said pin thereby allowing said staple engaging member to move somewhat with respect to said pin and said offset link; wherein axial movement of said armature is guided by the interior surface of said bore.

3. The stapler of claim 2 wherein said stapler includes mechanical means for displacing said armature axially toward said coil to reduce the kinetic energy of said armature resulting from activating said coil.

4. The stapler of claim 2 wherein an elastomeric member is placed within said bore to limit the extent of axial movement of said armature in said bore.

5. The stapler of claim 2 wherein said housing includes means for restraining rotation of said offset link about the axis of said bore.

6. An offset electric stapler having a housing containing a staple driving mechanism, switch means and a staple magazine, said staple driving mechanism comprising a cylindrical coil electrically connected to said switch means, said coil including a smooth cylindrical axial bore, a ferromagnetic armature disposed to move vertically within said bore upon actuating said coil; means for biasing said armature axially away from said coil wherein a portion of said armature projects into said coil prior to actuation of said coil; a flat staple driving member parallel to one edge of said housing and parallel to said coil; offset means affixed to one end of said armature for connecting said armature to said staple driving member said staple driving member being connected to said offset means such that limited relative motion is permitted therebetween; said armature being radially restrained solely by the bore of said coil.

7. The stapler of claim 6 wherein said offset means comprises a rigid polymeric member fastened to the upper end of a cylindrical armature.

8. An offset electric stapler having a housing containing a staple driving mechanism, switch means and a staple magazine, said staple driving mechanism comprising: a cylindrical coil electrically connected to said switch means, said coil being disposed around a smooth axial bore; an armature disposed to move coaxially within said bore when said coil is activated; said bore and said armature having a diametrical clearance in the range of from about 0.35 to 0.85 mm; spring means biasing said armature axially away from said coil; an offset link affixed to the upper end of said armature; an elongated flat staple engaging member having a staple engaging end and a driven end, said member being generally parallel to the axis of said coil, said driven end being affixed to said offset link by means of a pin projecting from said offset link engaging a hole in the driven end of said staple engaging member, said hole in said staple engaging member being larger than said pin thereby allowing said staple engaging member to move somewhat with respect to said pin and said offset link; wherein axial movement of said armature is guided solely by the interior surface of said bore.

* * * * *